US005588939A

United States Patent [19]

Zheng

[11] Patent Number: 5,588,939

[45] Date of Patent: Dec. 31, 1996

[54] EXERCISE BIKE WITH AMUSEMENT FEATURES

[76] Inventor: Yu Zheng, 1065 Howard Ave., Covina, Calif. 91722

[21] Appl. No.: 584,171

[22] Filed: Jan. 11, 1996

[51] Int. Cl.[6] ..... A63B 69/16

[52] U.S. Cl. ..... 482/57; 482/63; D21/194

[58] Field of Search ..... 482/57, 63, 64, 482/65; D21/194, 92, 59; 280/1.14, 288.4, 1.201; 446/411, 412

[56] References Cited

U.S. PATENT DOCUMENTS

| | | | |
|---|---|---|---|
| 162,682 | 4/1875 | Nichols | 446/412 |
| 182,147 | 9/1876 | Bailey | 446/411 |
| D. 182,791 | 5/1958 | Crawford | D21/92 |
| D. 232,751 | 9/1974 | Echterling | D21/92 |
| D. 236,904 | 9/1975 | Snyder | D21/92 |
| D. 272,927 | 3/1984 | Dropik | D21/92 |
| 443,631 | 12/1890 | Hamilton . | |
| 1,275,567 | 8/1918 | Koch, Jr. | 446/412 |
| 1,364,699 | 1/1921 | Brown . | |
| 1,521,946 | 1/1925 | Hargreaves . | |
| 2,454,656 | 11/1948 | Kollman . | |
| 2,521,331 | 9/1950 | Biggs | 446/411 |
| 3,503,614 | 3/1970 | Suroff et al. . | |
| 3,777,745 | 12/1973 | Simjian . | |
| 4,003,375 | 1/1977 | Simjian . | |
| 4,542,897 | 9/1985 | Melton et al. . | |
| 4,705,268 | 10/1987 | Nadeau . | |
| 4,709,917 | 12/1987 | Yang . | |
| 4,743,008 | 5/1988 | Fermaglich et al. . | |
| 4,910,053 | 3/1990 | McDonald et al. | 280/288.4 |
| 4,915,376 | 4/1990 | St. Clair . | |
| 5,256,127 | 10/1993 | Yeh . | |
| 5,393,281 | 2/1995 | Chen . | |

*Primary Examiner*—Lynne A. Reichard
*Attorney, Agent, or Firm*—Raymond Sun

[57] ABSTRACT

Exercise apparatus provide ornaments such as colored balls housed in rotatable cylindrical or circular enclosures, with the cylindrical or circular enclosures being rotated by use of the exercise apparatus. The rotation of the cylindrical or circular enclosures cause the ornaments to bounce around inside the enclosures, thereby providing an aesthetically pleasing appearance and significant amusement to the user.

6 Claims, 8 Drawing Sheets

EXERCISE BIKE WITH AMUSEMENT FEATURES

BACKGROUND OF THE INVENTION

1. Field of the Invention

The present invention relates to exercise apparatus, and in particular, to exercise apparatus that incorporate amusement or entertainment features to make the use of the exercise apparatus more enjoyable.

2. Description of the Prior Art

Exercise has become very popular in recent years as people have come to recognize the virtues and importance of exercise to good health. As a result, a wide variety of exercise machines and equipment, such as treadmills, stationary bicycles, rowing machines, steppers, and others, have been provided for use by people of all ages.

Unfortunately, the use of exercise machines can become rather monotonous, and only the dedicated fitness buffs and those whose health problems mandate the frequent use of such exercise machines will be able to continue their exercise routines on a regular basis. For most other people, the monotony soon overwhelms their desire to exercise, and they soon fall out of their exercise routines.

It is also important for children to be introduced to the benefits of regular exercise. However, the monotony problem is more severe for children, since they tend to be more restless and less dedicated to anything at their young ages. Children also tend to look for different forms of amusement or encouragement. Therefore, in order for children to be attracted to frequent exercise, it is important to encourage children to use the exercise machines.

Past attempts have been made to encourage the user to use exercise machines. Such attempts use amusement to encourage a user to continue using the exercise machine. For example, U.S. Pat. No. 4,542,897 (Melton et al.) discloses a stationary bicycle in which rotation of its pedals will allow the user to control a video game computer. U.S. Pat. No. 4,705,268 (Nadeau) discloses a rowing machine which produces a pleasing electronic tone when the user has reached each end of the rowing motion. U.S. Pat. No. 4,915,376 (St. Clair) discloses an exercise machine that takes the form of an animal. When the pedals L are rotated, the animal is caused to move in an upward and forward, and reverse elliptical pattern to simulate the running movement of the animal. U.S. Pat. No. 5,393,281 (Chen) discloses a stationary bicycle in which rotation of the pedals will actuate a fan 40, which in turn blows a float 50 upwardly along a rod 30.

In spite of the above examples, there still remains a need for exercise apparatus that provide amusement as an incentive for children, especially younger toddlers, to use the exercise apparatus on a frequent and regular basis.

SUMMARY OF THE DISCLOSURE

In order to accomplish the objects of the present invention, there is provided, in a first preferred embodiment of the present invention, an exercise apparatus having a movable belt assembly supported between a pair of frames. The belt assembly includes a pair of rollers, and a continuous belt supported at opposite ends by the pair of rollers. The exercise apparatus further includes at least one substantially transparent cylinder rotatably supported between the pair of frames and having a first cylinder. The belt and the first cylinder are positioned such that the outer surface of the belt is in contact with the outer surface of the first cylinder, so that movement of the belt causes rotation of the first cylinder in a first direction. A plurality of ornaments are provided inside at least one of the cylinders. In addition, the exercise apparatus further includes a second cylinder, with the first and second cylinders positioned such that the outer surfaces of the first and second cylinders contact each other, so that rotation of the first cylinder in the first direction causes rotation of the second cylinder in a second direction. The exercise apparatus further includes a third cylinder, with the second and third cylinders positioned such that the outer surfaces of the second and third cylinders contact each other, so that rotation of the second cylinder in the second direction causes rotation of the third cylinder in the first direction. The outer surfaces of the cylinders further include a plurality of ribs. In addition, one or more wheels may be coupled to the rollers, with rotation of the rollers causing the wheels to rotate and to thereby drive other amusement devices, such as timing, lighting, and speaker devices.

In a second preferred embodiment of the present invention, the exercise apparatus has a base with a seat assembly provided thereon, and a flywheel having a plurality of ornaments provided therein. The exercise apparatus further includes a housing assembly connected to the base for rotatably supporting the flywheel, and a pedal assembly rotatably coupled to the housing assembly and the flywheel, so that rotation of the pedal assembly will cause the flywheel to rotate, which in turn causes the plurality of ornaments inside the flywheel to bounce around. In one preferred embodiment, the flywheel has a shaft extending therethrough, and the pedal assembly includes a cylindrical rod that is received inside the shaft of the flywheel so that rotation of the rod causes the flywheel to rotate. In another preferred embodiment, the pedal assembly has a cylindrical rod, and the rod and flywheel are positioned such that the outer surface of the rod contacts the circumferential edge of the flywheel so that rotation of the rod will cause the flywheel to rotate. In yet another preferred embodiment, a chain couples the outer surface of the cylindrical rod and the circumferential edge of the flywheel so that rotation of the rod will cause the flywheel to rotate. The flywheel has a central wheel encased by two wheel casings. The flywheel in one embodiment has a plurality of projections provided on the outer surfaces of the central wheel for stirring up the plurality of ornaments. In another embodiment, the flywheel has a plurality of spokes for stirring up the plurality of ornaments.

The exercise apparatus according to the present invention therefore provides a plurality of ornaments, such as balls, cubes, rattles and other small objects, inside the cylinders and flywheel, so that they may be rotated and moved together with the use of the exercise apparatus. These moving ornaments provide amusement and incentive to the user, and in particular, children, to continue to use the exercise apparatus on a regular and frequent basis.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The exercise apparatus according to the present invention provide ornaments such as colored balls housed in a rotatable cylindrical or circular enclosure, with the cylindrical or circular enclosures being rotated by use of the exercise apparatus. The rotation of the cylindrical or circular enclosures cause the color balls to bounce around inside the enclosures, thereby providing an aesthetically pleasing appearance and significant amusement to the user. In some other embodiments according to the present invention, use of the exercise apparatus will drive gears, pulleys and other linking mechanisms to drive other devices which bring some form of amusement, such as lighting, timing and speaker devices. Although the exercise apparatus according to the present invention are especially suitable for use by children, their use and applicability are not so limited and they can also be used and enjoyed by adults.

Figure 1:
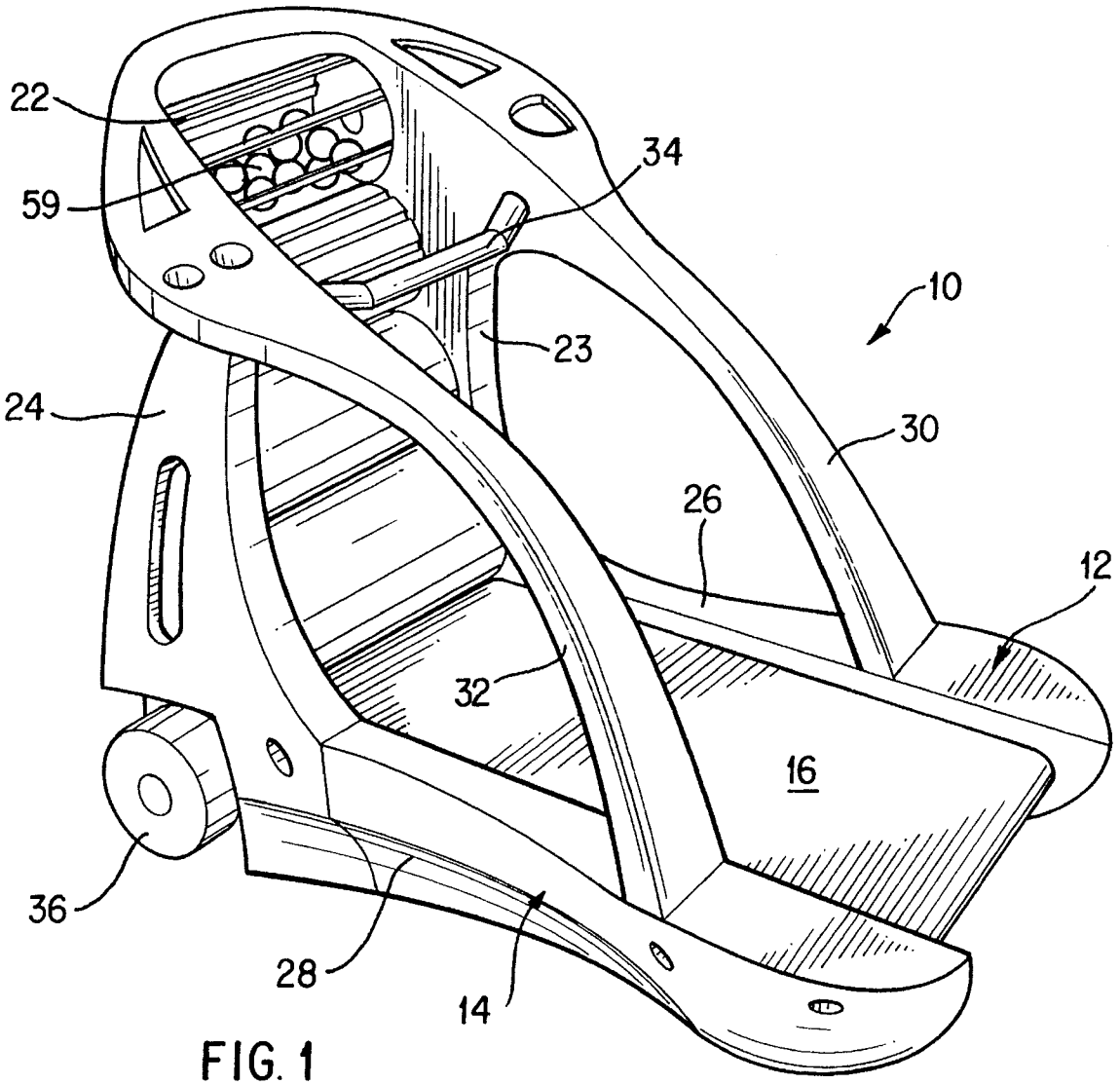
FIG. 1 is a perspective view of a first embodiment of the present invention, which is a treadmill having a rotating cylinder that contains a plurality of balls.
Figure 2:
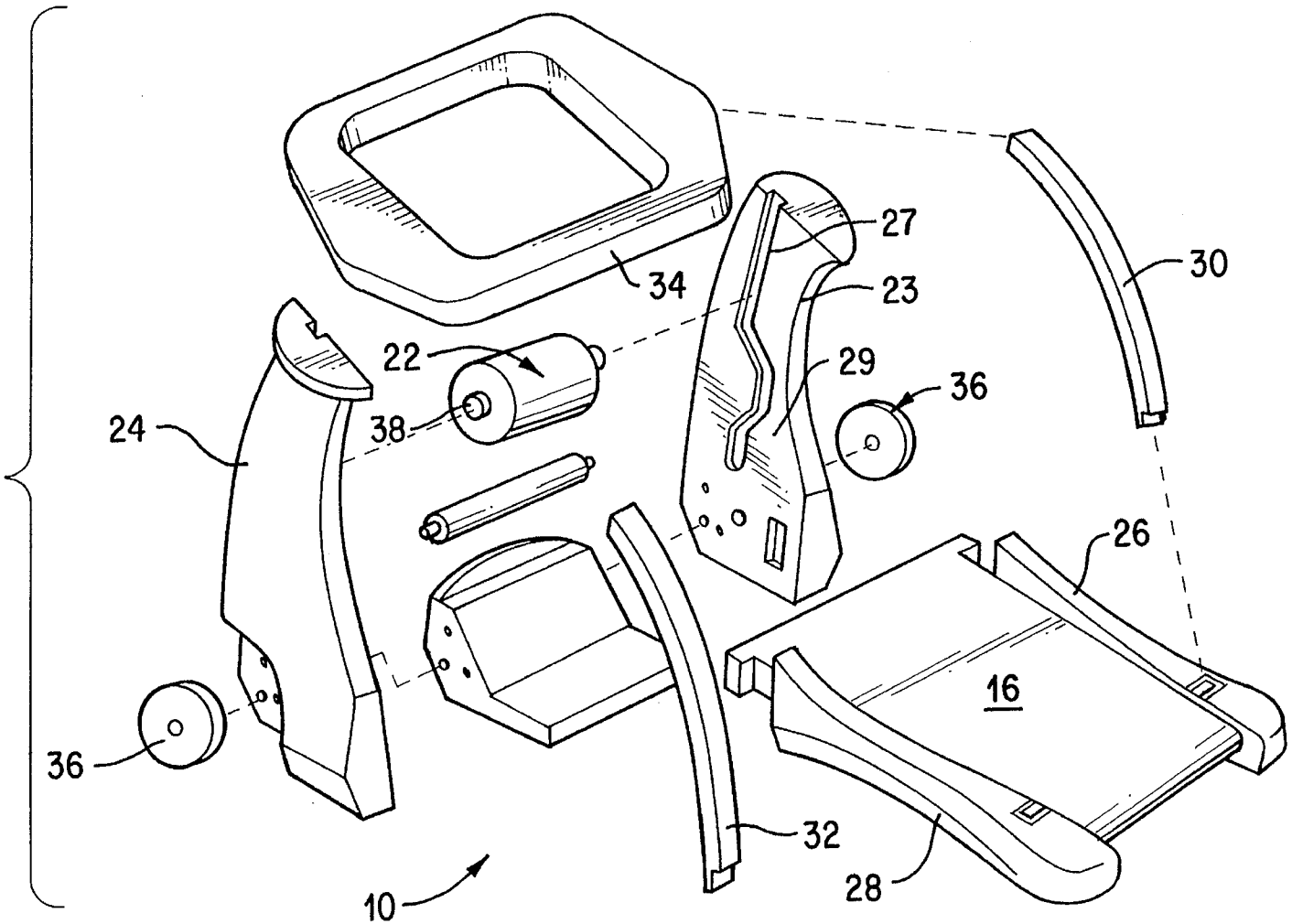
FIG. 2 is a perspective exploded view illustrating the various components of the treadmill of FIG. 1.
Figure 3:
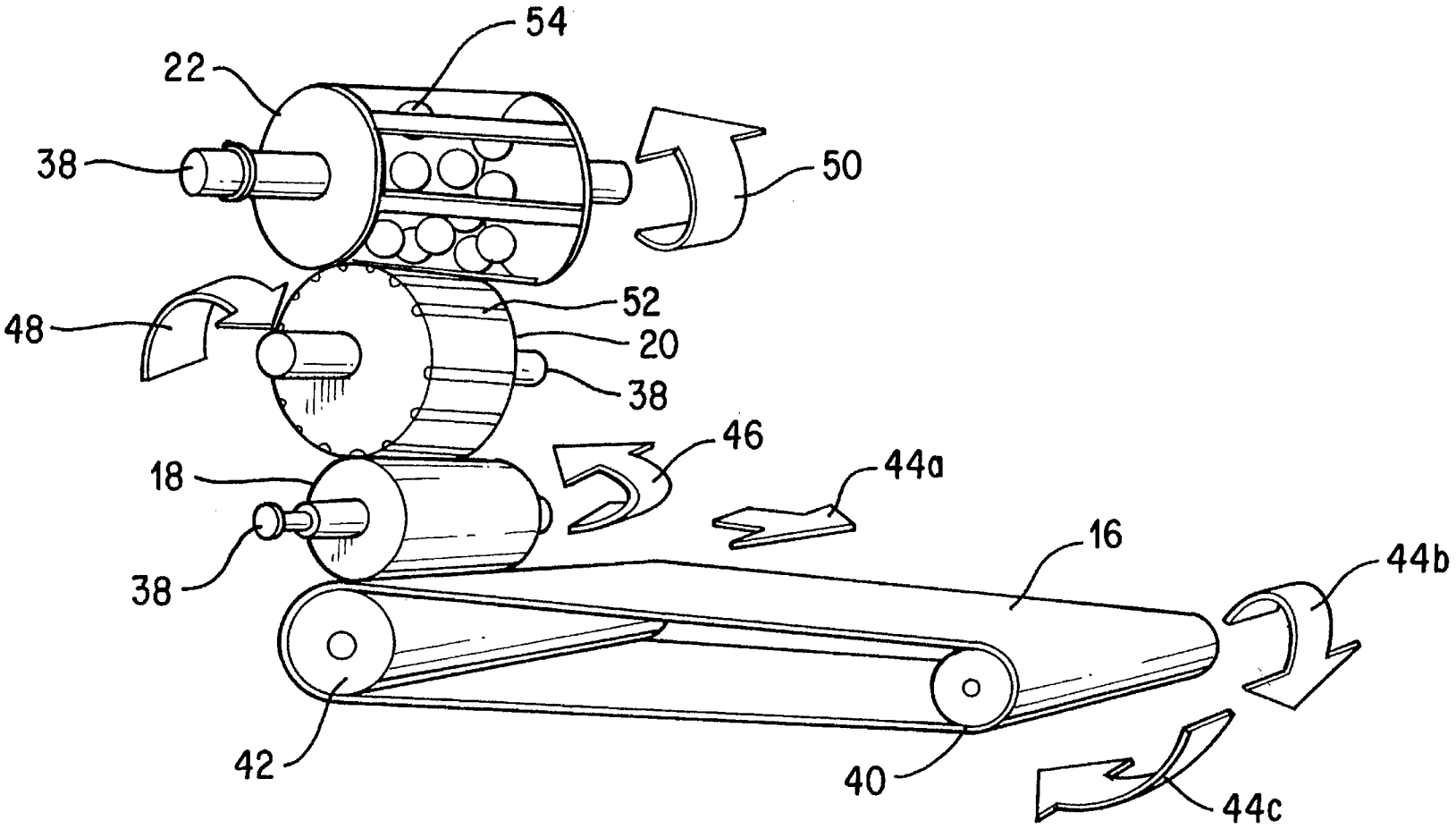
FIG. 3 is a perspective exploded view illustrating the belt and rotating cylinders of the treadmill of FIG. 1.

The first preferred embodiment of an exercise apparatus according to the present invention is a treadmill 10 as illustrated in FIGS. 1–3. The treadmill 10 has two side housing frames 12 and 14 that hold and support a continuous belt 16 along their horizontal portions 26 and 28, respectively. The frames 12 and 14 include front portions 23 and 24, respectively, that are connected to the horizontal portions 26 and 28, respectively. The front portions 23 and 24 extend vertically and have grooves 27 which support a plurality of rotating cylinders 18, 20 and 22. Two side handle bars 30 and 32 connect a front handle assembly 34 with the horizontal portions 26, 28, respectively. The front handle assembly 34 is supported at the top of the front portions 23 and 24. The horizontal portions 26 and 28 are adapted to rest on the ground to support the treadmill 10. One or more wheels 36 may be provided at the front end of the front portions 23 and 24 for rolling the treadmill 10 along the ground from one location to another. Each of the components described above may be connected to each other by conventional methods. The user may grip the handle bars 30, 32 and 34 during use of the treadmill 10.

Referring to FIG. 3, the continuous belt 16 is supported by a pair of rollers 40 and 42 at opposite ends. Rollers 40 and 42 hold the belt 16 taut, and they rotate synchronously to move the belt 16. The rollers 40 and 42 are rotatably held in position between the horizontal portions 26 and 28. The cylinders 18, 20 and 22 each have shafts 38 on opposite ends that are adapted to be received in the grooves 27 provided in the inner walls 29 of the front portions 23 and 24 of the frames 12 and 14. The cylinders 18, 20 and 22 and the belt 16 are positioned such that their outer surfaces contact each other so that rotation of the belt 16 will cause the cylinders 18, 20 and 22 to rotate as well. Specifically, the upper surface of the belt 16 is in contact with the outer surface of cylinder 18, the outer surface of cylinder 18 contacts the outer surface of cylinder 20, and the outer surface of cylinder 20 contacts the outer surface of cylinder 22. Therefore, movement by the belt 16 in the direction indicated by the arrows **44*a*, 44*b* and 44*c* causes the cylinder 18 to rotate counter-clockwise as indicated by the arrow 46. Counter-clockwise rotation by cylinder 18 in turn causes the cylinder 20 to rotate in a clockwise direction as indicated by the arrow 48, which in turn causes the cylinder 22 to rotate counter-clockwise as indicated by the arrow 50**.

Ribs 52 or other protrusions or bumps may be provided on the outer surfaces of the cylinders 18, 20 and 22 to improve the contact between the outer surfaces of the respective cylinders 18, 20 and 22, thereby ensuring that the movement of the belt 16 will cause all the cylinders 18, 20 and 22 to rotate in a synchronous manner. In addition, colored balls 54 or other ornaments are provided inside at least one cylinder 22 so that the rotation of that cylinder 22 will cause the balls 54 to bounce around, creating an aesthetically pleasing sight and providing amusement and incentive to the user to continue to move the belt 16.

Figure 4:
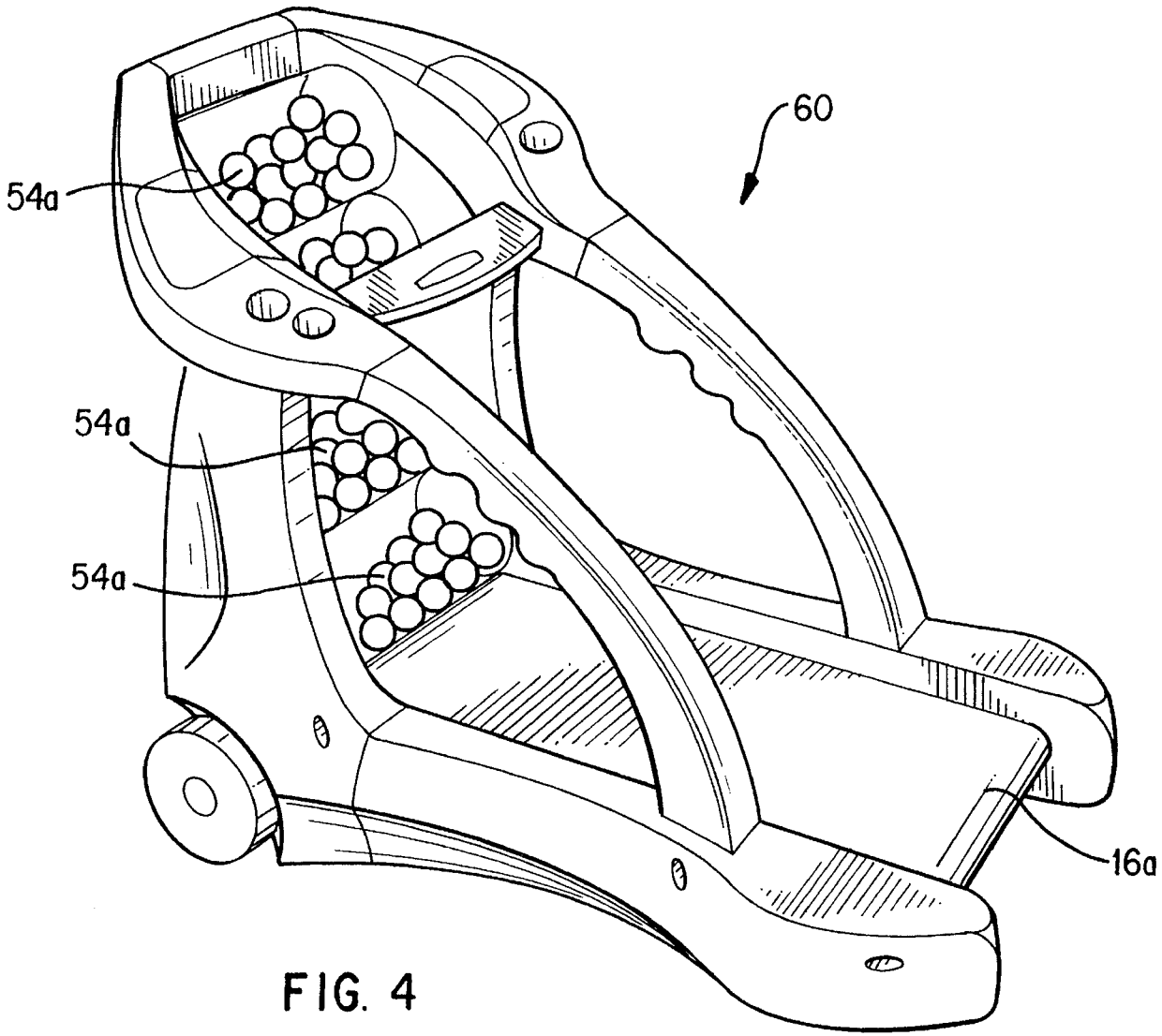
FIG. 4 is a perspective view of a second embodiment of the present invention, which is a treadmill having a plurality of rotating cylinders that contain a plurality of balls.

Alternatively, as illustrated in the treadmill 60 in FIG. 4 according to a second preferred embodiment of the present invention, all the cylinders can be provided with bouncing balls **54*a* or other ornaments so that rotation of the belt 16*a* will cause all the balls 54*a* in all the cylinders to bounce around. Aside from the provision of balls 54*a* in all the cylinders, the treadmill 60 is similar to the treadmill 10 of FIG. 1**.

Although the treadmills 10 and 60 are illustrated as having a plurality of cylinders, any number of cylinders can be provided without departing from the spirit and scope of the present invention. For example, it is possible to provide only one cylinder 18 in contact with the belt 16, as long as the cylinder 18 contains a plurality of balls 54 or ornaments therein. As another example, the treadmill 60 is illustrated as having four cylinders.

The treadmills 10 and 60 can be electrically and mechanically driven, in which a switch is turned on to cause a motor to move the belt 16 at the desired rates. Alternatively, when provided specifically for use by children, the treadmills 10 and 60 can be manually driven in that a running or walking motion by the user is required to move the belt 16.

Figure 5:
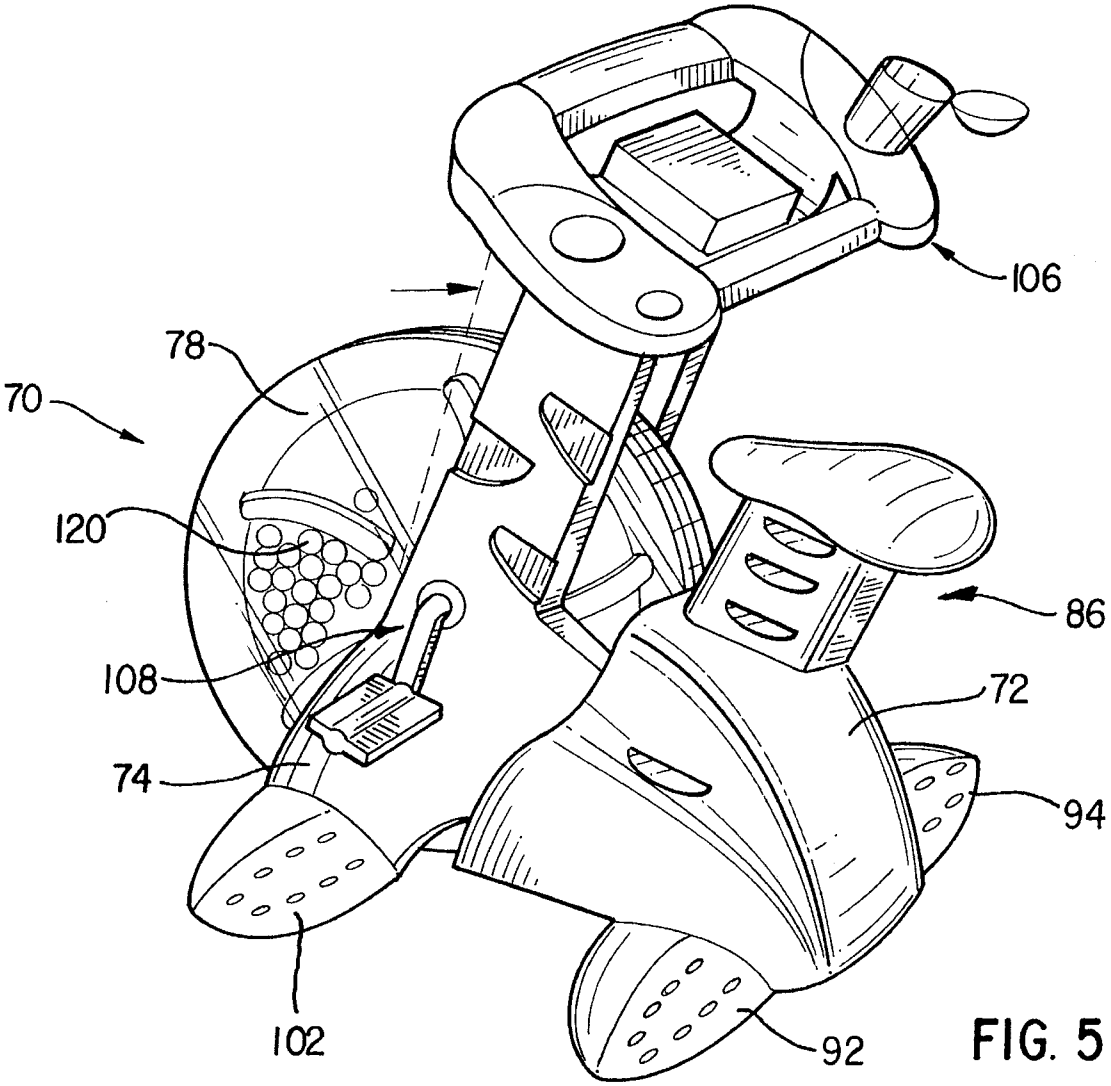
FIG. 5 is a perspective view of a third embodiment of the present invention, which is a stationary bicycle having a flywheel that contains a plurality of balls.
Figure 6:
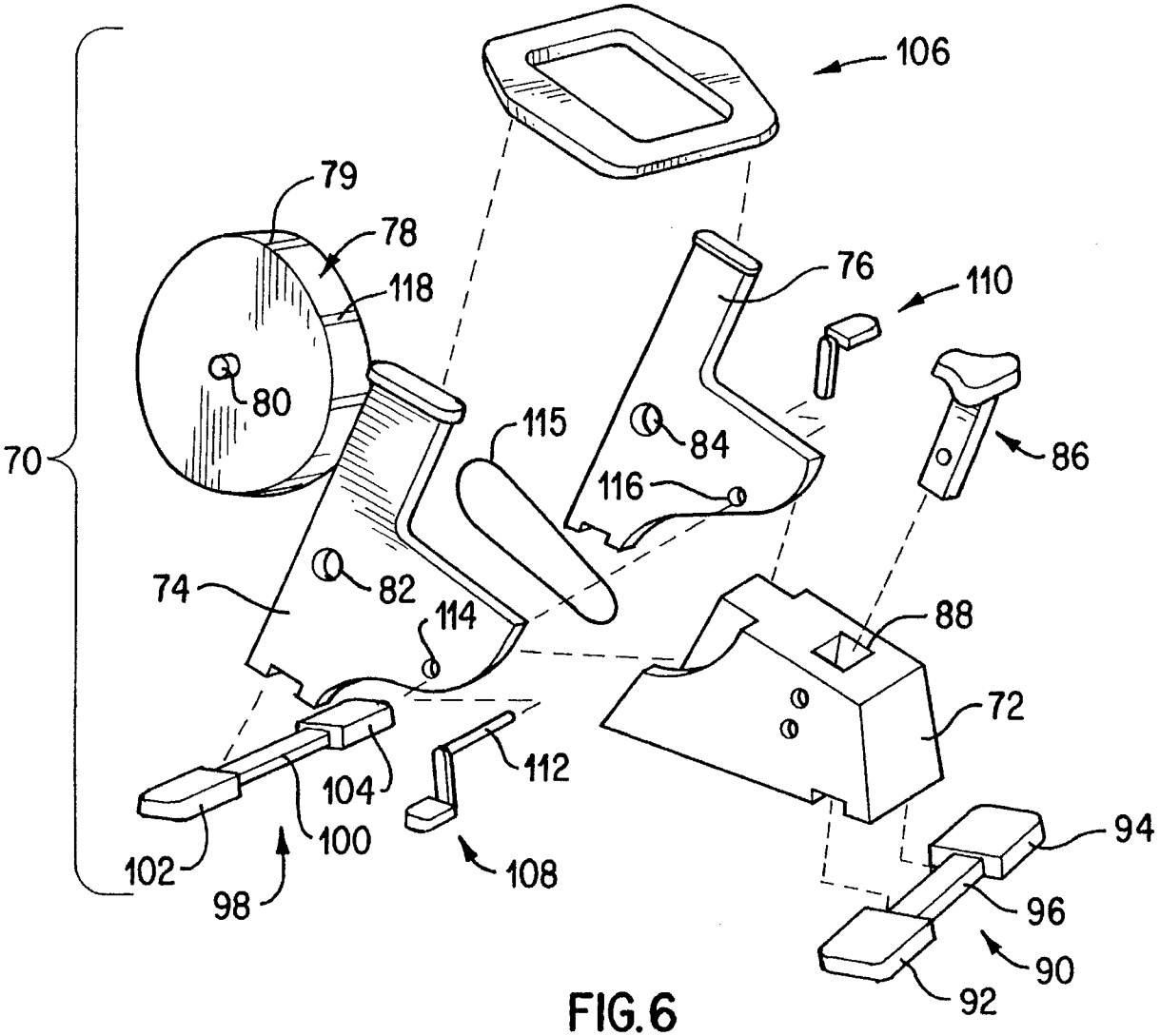
FIG. 6 is a perspective exploded view illustrating the various components of the stationary bicycle of FIG. 4.
Figure 7:
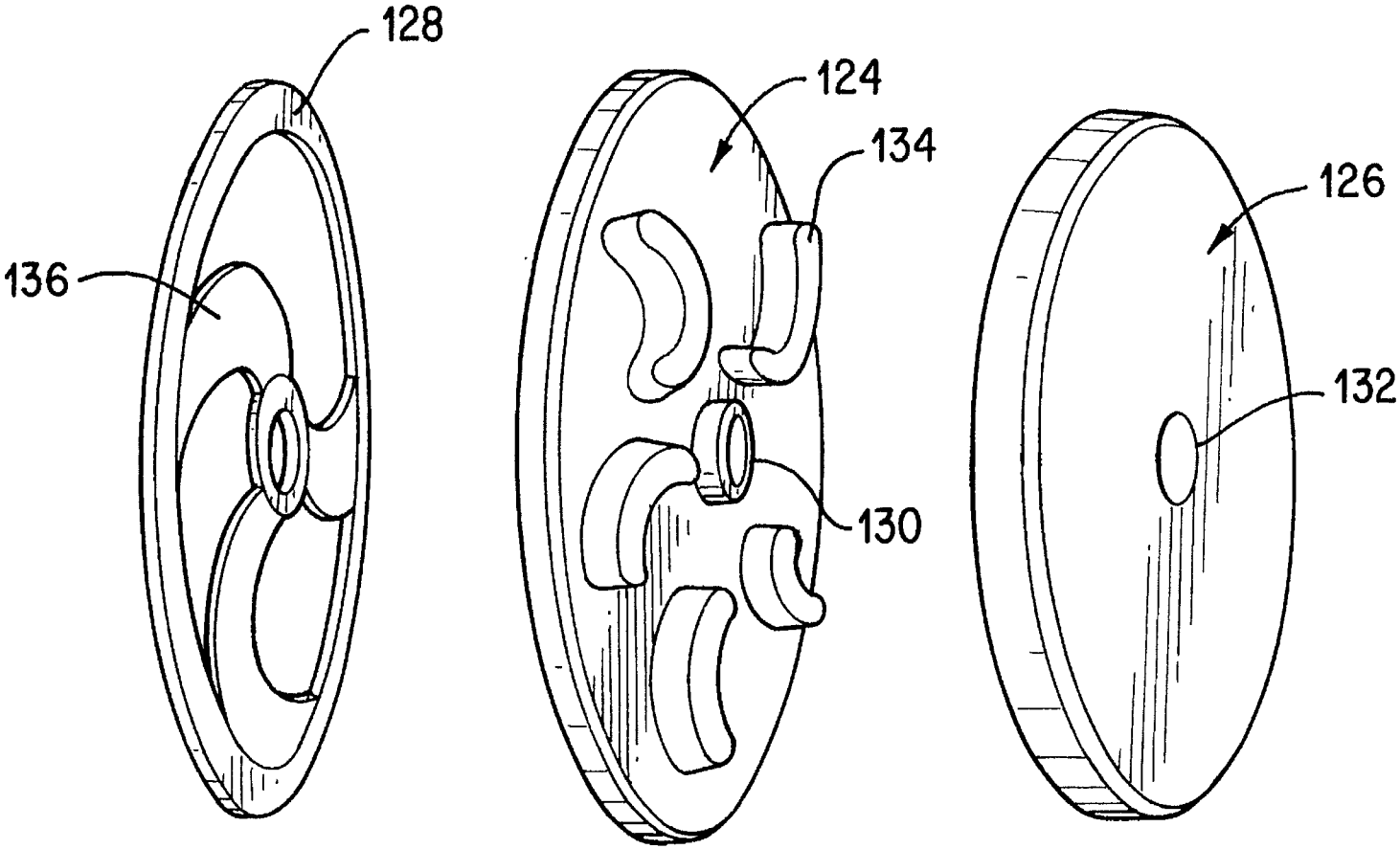
FIG. 7 is a perspective exploded view illustrating the flywheel of the stationary bicycle of FIG. 5.

Another preferred embodiment of an exercise apparatus according to the present invention is a stationary bicycle 70 as illustrated in FIGS. 5–7. The bicycle 70 has a base 72 and a housing assembly supported at the front of the base 72. The housing assembly includes a left frame 74 and right frame 76 having holes 82 and 84, respectively, that are adapted to receive the shafts 80 provided on opposing surfaces of a flywheel 78 to hold the flywheel 78 for rotation between the two frames 74 and 76. A seat assembly 86 is secured in a bore 88 provided in the base 72. The bottom of the base 72 rests on a leg assembly 90 that has a shaft or bar 96 connecting two feet 92 and 94. Similarly, the bottoms of the frames 74 and 76 rest on another leg assembly 98 that has a shaft or bar 100 connecting two feet 102 and 104. A handle assembly 106 is supported at the top of the frames 74 and 76. Each of the components described above may be connected to each other by conventional methods.

A pedal assembly includes pedals 108 and 110 connected by a thin cylindrical rod 112. As shown in FIG. 5, the rod 112 is passed through holes 82 and 84, and through the shaft 80 which extends through the flywheel 78, so that rotation of the rod 112 rotates the flywheel 78. Alternatively, as shown in FIG. 5, the rod 112 is passed through holes 114 and 116, and a chain 115 connects the rod 112 and the circumferential edge 79 of the flywheel 78 so that rotation of the rod 112 will cause the flywheel 78 to rotate. As a further alternative, the rod 112 is passed through holes 114 and 116, and the outer surface of the cylindrical rod 112 is positioned to contact the circumferential edge 79 of the flywheel 78 so that rotation of the rod 112 will again rotate the flywheel 78.

The flywheel 78 preferably contains a plurality of balls 120 or ornaments inside its interior. Therefore, when the user rides the bicycle 70 by rotating the pedals 108 and 110, the rotation of the rod 112 will cause the flywheel 78 to rotate, thereby causing the balls 120 or ornaments to bounce around, creating an aesthetically pleasing sight and providing amusement and incentive to the user to continue to ride the bicycle 70. Ribs 118 or protrusions or bumps can be provided on the circumferential edge 79 of the flywheel 78 to improve the contact between the circumferential edge 79 of the flywheel 78 and the rod 112, thereby ensuring that rotation of the rod 112 will cause the flywheel 78 to rotate. Ribs or protrusions or bumps (not shown) can also be provided on the rod 112 for the same purpose.

FIG. 7 illustrates the construction of the flywheel 78. The flywheel 78 according to one preferred embodiment has a central wheel 124 that is encased by wheel casings 126. Only one wheel casing 126 is illustrated in FIG. 7, the other being the same. The central wheel 124 has a central hub 130 that is adapted to be fitted with the central hub 132 of wheel casing 126. A plurality of curved projections 134 are provided on both surfaces of the central wheel 124. Therefore, when the flywheel 78 is rotated in the manner described above, the central wheel 124 rotates along with the flywheel 78, with the projections 134 stirring the colored balls 120 or ornaments. The projections 134 also provide a pleasing aesthetic appearance. Also illustrated in FIG. 7 is another preferred embodiment having a central wheel 128 which has curved spokes 136 that are also intended to stir the ornaments and to provide a pleasing aesthetic appearance.

The balls 54 and 120 according to the present invention are preferably multi-colored to provide an interesting and aesthetically pleasing contrast. Aside from the balls 54 and 120, other ornaments such as rattles, cubes and other small objects can also be provided inside the rotating cylinders 18, 20 and 22 and flywheel 78. Aside from being provided in different colors, the balls 54 and 120 and ornaments can be decorated with other designs or logos.

The rotating cylinders 18, 20 and 22 and the wheel casings 126 of the flywheel 78 according to the present invention are preferably transparent so that the balls or ornaments 54 and 120 are clearly visible. The rotating cylinders 18, 20 and 22 can be provided in the same shape and size, or they can be provided in different shapes and sizes as long as their outer surfaces are in contact with each other to facilitate the synchronous rotation of all cylinders.

The exercise apparatus 10, 60 and 70 according to the present invention may be provided in any shape or size, so that both children and adults can use the exercise apparatus. For example, the same exercise apparatus can be provided in two sizes so that a child and its parent can be exercising at the same time. In addition, the outer appearance of the exercise apparatus according to the present invention can be decorated with different decals, words or other ornamental designs.

While the exercise apparatus according to the present invention have been described in connection with rotating cylindrical or circular enclosures being rotated by use of the exercise apparatus to cause the color balls or ornaments to bounce around inside the enclosures, the present invention also encompasses other alternatives that provide amusement to the user of exercise apparatus upon the use of such apparatus.

Figure 8:
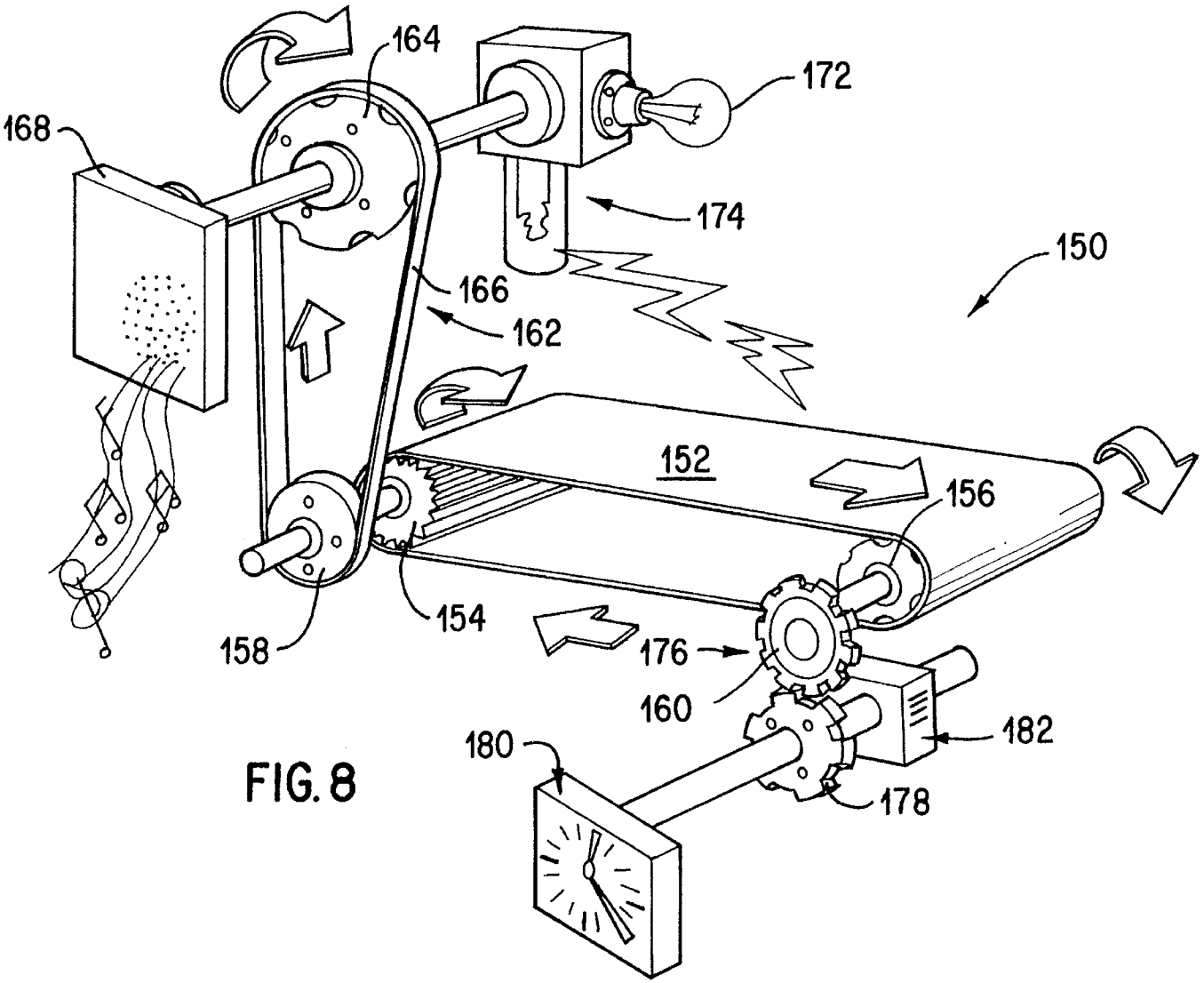
FIG. 8 is a partial perspective view of a fourth embodiment of the present invention illustrating a portion of a treadmill which can be used to drive other amusement features.

For example, FIG. 8 illustrates a portion of a treadmill device 150 in which rotation of its continuous belt 152 will drive, either individually or simultaneously, several amusement features. Specifically, the rollers 154 and 156 are connected to wheels 158 and 160, respectively, so that rotation of the rollers 154 and 156 (i.e., upon rotation of the belt 152) will cause the wheels 158 and 160 to drive other mechanisms. The wheel 158 is part of a belt-driven pulley system 162 that includes another wheel 164 and a belt 166, so that rotation of the wheel 158 will cause the wheel 164 to rotate, thereby simultaneously driving a speaker box 168 and a lighting box 170. The lighting box 170 is capable of turning on a light bulb 172 and producing lightning flashes 174, while the speaker box 168 produces sounds, tones or music. The wheel 160 is part of a gear system 176 in which the teeth of wheel 160 engage the teeth of another wheel 178 so that rotation of the wheel 160 turns on a timer or clock device 180 or drives a power generator 182. Although specific amusement devices are illustrated in FIG. 8, it will be appreciated by those skilled in the art that other amusement devices and features can be provided without departing from the spirit and scope of the present invention. For example, the rotating cylinders described above in connection with the treadmills 10 and 60 can be provided in the front of treadmill 150 to be rotatably driven by the belt 152 along with the other features.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An exercise apparatus, comprising:

a base comprising a seat assembly provided thereon;

a flywheel comprising a plurality of ornaments provided therein;

a housing assembly connected to the base for rotatably supporting the flywheel; and a pedal assembly rotatably coupled to the housing assembly and the flywheel;

wherein rotation of the pedal assembly causes the flywheel to rotate, thereby causing the plurality of ornaments inside the flywheel to bounce around.

2. The apparatus of claim 1, wherein the flywheel comprises a shaft extending through the flywheel, and wherein the pedal assembly comprises a cylindrical rod that is received inside the shaft of the flywheel so that rotation of the rod will cause the flywheel to rotate.

3. The apparatus of claim 1, wherein the flywheel comprises a circumferential edge, and wherein the pedal assembly comprises a cylindrical rod comprising an outer surface, and wherein the rod and flywheel are positioned such that the outer surface of the rod contacts the circumferential edge of the flywheel so that rotation of the rod will cause the flywheel to rotate.

4. The apparatus of claim 1, wherein the flywheel comprises a circumferential edge, and wherein the pedal assembly comprises a cylindrical rod comprising an outer surface, and further comprising a chain coupling the outer surface of the cylindrical rod and the circumferential edge of the flywheel so that rotation of the rod will cause the flywheel to rotate.

5. The apparatus of claim 1, wherein the flywheel comprises a central wheel encased by two wheel casings, the central wheel comprising outer surfaces and a plurality of projections provided on the outer surfaces of the central wheel for stirring up the plurality of ornaments.

6. The apparatus of claim 1, wherein the flywheel comprises a central wheel encased by two wheel casings, the central wheel comprising a plurality of spokes for stirring up the plurality of ornaments.

* * * * *